US005617787A

United States Patent [19]

Takita et al.

[11] Patent Number: 5,617,787

[45] Date of Patent: Apr. 8, 1997

[54] PROCESS FOR PERFORATING STENCIL PRINTING SHEET

[75] Inventors: Nagon Takita; Yasuo Yamamoto, both of Tokyo, Japan

[73] Assignee: Riso Kagaku Corporation, Tokyo, Japan

[21] Appl. No.: 532,243

[22] Filed: Sep. 22, 1995

[30] Foreign Application Priority Data

Sep. 30, 1994 [JP] Japan ..... 6-237541

[51] Int. Cl.[6] ..... B41M 1/12

[52] U.S. Cl. ..... 101/129; 101/128.4

[58] Field of Search ..... 101/129, 128.4, 101/128.21, 114

[56] References Cited

U.S. PATENT DOCUMENTS

| | | | |
|---|---|---|---|
| 3,862,396 | 1/1975 | Machida et al. | 101/128.4 |
| 3,871,899 | 3/1975 | Andersen | 101/128.21 |
| 5,195,832 | 3/1993 | Fujikawa et al. | 101/128.21 |
| 5,243,906 | 9/1993 | Okusawa | 101/128.4 |
| 5,251,567 | 10/1993 | Fuwa | 101/128.4 |
| 5,415,090 | 5/1995 | Natori et al. | 101/128.21 |
| 5,417,156 | 5/1995 | Tateishi et al. | 101/128.1 |

FOREIGN PATENT DOCUMENTS

| | | |
|---|---|---|
| 60-154068 | 8/1985 | Japan . |
| 63-077742 | 4/1988 | Japan . |
| 1-249389 | 10/1989 | Japan . |
| 6-191003 | 7/1994 | Japan . |

*Primary Examiner*—Edgar S. Burr
*Assistant Examiner*—Anthony H. Nguyen
*Attorney, Agent, or Firm*—Fay, Sharpe, Beall, Fagan, Minnich & McKee

[57] ABSTRACT

A process for perforating a stencil sheet comprising a thermoplastic resin film is disclosed which process comprises melting predetermined portions of the thermoplastic resin film with the heat from heat-generating elements to form perforations while applying a pressure to the film and under such a condition that the film is spaced away from the heat-generating elements by a close distance. According to the process of the invention, perforations through which ink passes smoothly can be formed in a stencil sheet using a thermal head and thus clear images can be obtained.

8 Claims, 3 Drawing Sheets

PROCESS FOR PERFORATING STENCIL PRINTING SHEET

BACKGROUND OF THE INVENTION

1. Field of the Invention

The present invention relates to a process for perforating a stencil printing sheet. More particularly, the invention relates to a process for perforating a heat-sensitive stencil printing sheet in which excellent perforated images can be formed in a heat-sensitive stencil printing sheet.

2. Related Art

Stencil printing employs a stencil printing sheet (hereinafter may be referred to as stencil sheet) which is made either solely of a synthetic thermoplastic resin film (hereinafter may be referred to as resinous film) or in combination of a synthetic thermoplastic resin film and a porous support affixed thereto. Perforation of the stencil sheet is carried out, for instance, by first bringing image portions of a manuscript that contains a light-absorbing substance (usually, carbon black) into a close adhesion on the surface of the resinous film of stencil sheet, and irradiating infrared-rich rays from the sheet's side to generate heat in the image portions of the manuscript, thereby forming perforated images corresponding to the images of the manuscript. Alternatively, a plurality of heat-generating elements in a thermal head are contacted with the resinous film to selectively generate heat and to form perforated images corresponding to the images contained in the manuscript.

As mentioned above, according to these methods, perforations are formed by selectively melting a resinous film with the heat generated by the absorption of light energy in image portions of a manuscript, or with the heat generated in heat-generating elements. These perforation methods have the drawback that they tend to cause a perforation failure due to an adhesion failure between the resinous film and manuscript, or due to a contact failure between the resinous film and heat-generating elements. In addition, since the portions of the resinous film melted with heat is restrained by the manuscript or heat-generating elements, it cannot shrink back toward the periphery of perforations, partly deposit on heat-generating sections (image portions of the manuscript and heat-generating elements) as a melt, and thus causes the impediment of heat conduction. The melt, if not deposited onto heat-generating sections, stays in perforations as a melt residue to hinder the printing ink from flowing through the perforations during printing. As a result, clear images were hard to obtain.

Accordingly, an object of the present invention is to provide an improved process for perforating a stencil printing sheet in which excellent perforated images can be formed in a stencil printing sheet by using a thermal head, ink is smoothly passed through perforations, and clear printed images can be obtained.

As the results of extensive studies by the present inventors, it has been found that when the melted portions of the thermoplastic resin film is allowed to shrink back to the periphery of perforations during the formation of perforations in the resinous film with the heat from heat-generating elements of a thermal head, the stencil sheet is neatly perforated leaving substantially no melted resin in the perforations and without permitting deposition of the melted resin on heat-generating elements so that perforated images through which printing ink smoothly passes can be formed, and thus clear printing images can be obtained.

SUMMARY OF THE INVENTION

The present invention is concerned with a process for perforating a stencil sheet comprising a thermoplastic resin film, which process comprises melting predetermined portions of a thermoplastic resin film with the heat from heat-generating elements to form perforations while applying a pressure to the film and under such a condition that the film is spaced away from the heat-generating elements by a close distance.

The distance between the thermoplastic resin film and the heat-generating elements is preferably 1 μm or less.

DESCRIPTION OF THE PREFERRED EMBODIMENTS

Figure 1:
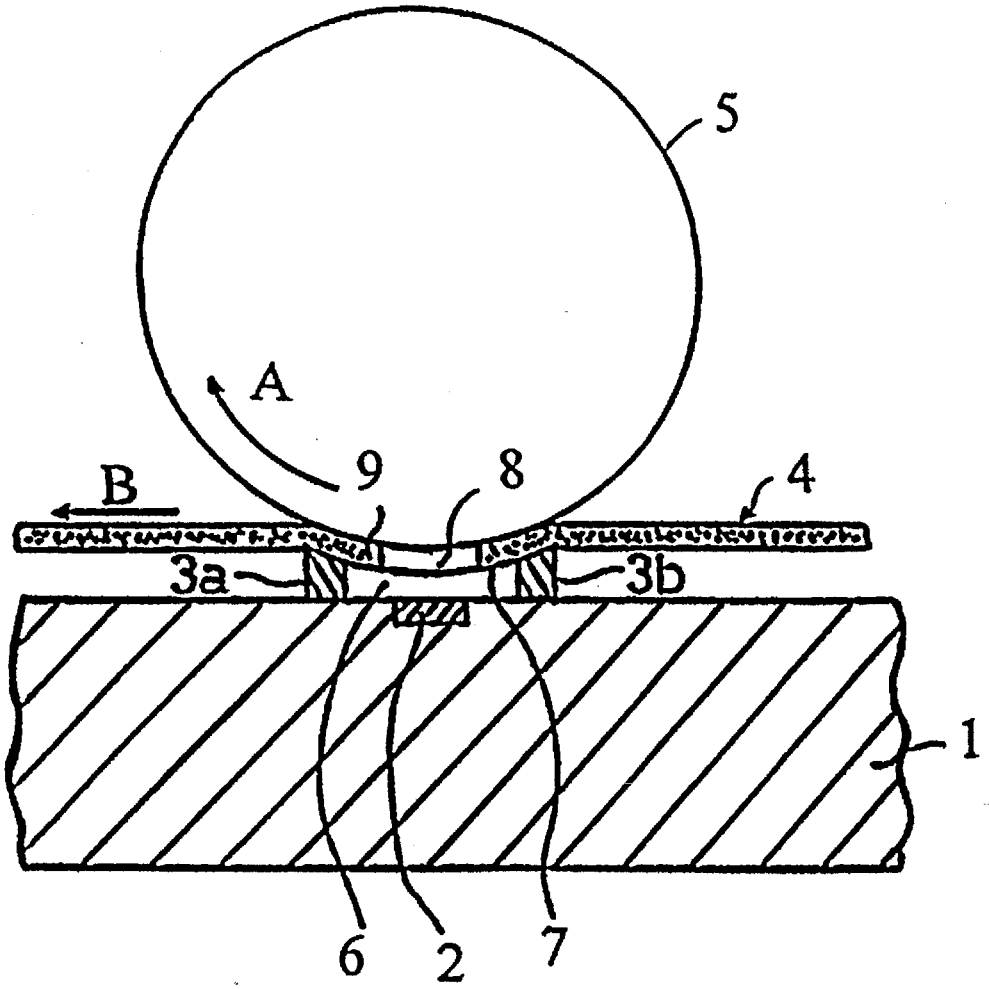
FIG. 1 is an illustration showing an example of the process for perforating a heat-sensitive stencil sheet according to the present invention.

The stencil sheet which is used in the present invention may be formed solely of a thermoplastic resin film. Alternatively, the stencil sheet may be formed of a thermoplastic resin film and a porous support affixed thereto.

As examples of the thermoplastic resin film, there are used known synthetic thermoplastic resin films such as polyester films, polyethylene films, and polypropylene films. Especially, the films which had been subjected to a stretching treatment are preferably used. The thickness of the film is generally from 0.5 to 20 μm, and preferably from 0.5 to 10 μm. For example, when a polyester film is used, it preferably has a thickness from 1.5 to 2 μm, a melting point from 190° to 230° C. and longitudinal and transverse stretching magnifications of about 4.

The porous support used in the present invention is made of a conventional material. When a sheet of washi paper (Japanese paper), cloth, or non-woven fabric made of natural fibers or synthetic fibers is used, its thickness is preferably from 30 to 50 μm, and when a screen of synthetic fibers woven into rectangular grids is used, its thickness is preferably as much as 50 to 100 μm. The fineness and density of fibers can be suitably decided depending on the size of heat-generating elements as long as the perforations are not plugged. The method for adhering the porous support to the thermoplastic resin film is not particularly limited, either. For instance, the porous support can be thermally fused to the resin film or adhered to the resin film with an adhesive. When the porous support is affixed to the resinous film, transferring efficiency of the stencil sheet is improved. In addition, the development of wrinkles in the stencil sheet can be avoided because the shrinkage of the film at the periphery of perforations due to the heat diffused from the heat-generating elements during the melt-perforation of the resinous film can be controlled.

In the present invention, the stencil sheet is perforated with a thermal head under such conditions that the thermoplastic resin film of the stencil sheet does not contact with the heat-generating elements of the thermal head and a predetermined interval is maintained between the two.

Currently available heat-generating elements have a limit in generating high thermal energy because of the shortage of their durability and service life. Generally, the temperature of the heat-generating elements is set to a relatively low range of 300° to 400° C. As a result, if the distance between the resinous film and heat-generating elements is in excess of 1 μm, the heat conduction decreases, and satisfactory perforations cannot be obtained. Accordingly, in order to obtain excellent perforations, the interval should be 1 μm or less. If a higher thermal energy is somehow available, good perforations may be obtained even though the interval between the resinous film and heat-generating elements is greater than 1 μm. In addition, the smaller the distance between the resinous film and the heat-generating elements (as long as they are not in contact), the better perforations having the shape close to that of heat-generating elements can be obtained. Therefore, a smaller distance is preferable because good perforations can be obtained with low thermal energy, which in turn enhances durability and service life of the heat-generating elements.

Thermal energy is transferred from the heat-generating elements to the resinous film placed slightly apart from the elements. Therefore, the movement, in the plane of the film, of the resin melted with thermal energy is not restricted at all. Thus, the melted resin can freely shrink in every direction in the plane of the film to form perforations. Consequently, conventional problems of deposition of melted resin onto heat-generating elements or staying of melted resin in perforations are avoided; the decrease in heat conduction efficiency and blockage of ink passage can be avoided; and as a result, clear images can be obtained.

In the present invention, a pressure is applied to the thermoplastic resin film when the film is perforated with the thermal energy from heat-generating elements.

If the pressure is not given to the film during the perforation of resinous film, i.e., during the transfer of thermal energy from the heat-generating elements to the stencil sheet, the thermal energy from the heat-generating elements contracts the heated parts of the resinous film rather than melting the parts,. since the resinous film and the heat-generating elements are not contacted. This causes wrinkles in the film.

It is sufficient if a pressure is applied to the resinous film only at the time of perforation. Pressure is applied to the resinous film of the stencil sheet while, for instance, disposing a platen roller so as to push downward the heat-sensitive stencil sheet passing over the heat-generating elements without contacting with the stencil sheet, and pressing the stencil sheet while rotating the platen roller in the direction of the advance of the stencil sheet during perforation. The pressure given by the platen roller against the stencil sheet differs depending on the thickness and kinds of the resinous film and porous support. The surface of the resinous film to be perforated must not contact with heat-generating elements of the thermal head during the film is conveyed. Under normal circumstances, the pressure is preferably from 0.1 to 0.25 kgf/cm. The platen roller used in the present invention is usually made of an elastic material such as rubber and has a diameter of less than about 25 mm. In view of the perforation efficiency, a rubber-made roller having a JIS K6301 A-hardness of about 30° to 90° is preferred.

The thermal head used in the present invention has, for example, a plurality of heat-generating elements aligned, with a density of 300 to 600 dpi. The shape and size of each heat-generating element is preferably a rectangular shape with a size from 40 to 70 μm in the direction of advance of the manuscript (sub scanning direction) and from 30 to 45 μm in the direction perpendicular to the sub scanning direction (main scanning direction). Generally, electric energy from 40 to 75 μJ is selectively supplied to the heat-generating elements according to the image information from the manuscript. Whereas the heat-generating elements preferably generate heat of as high temperature as possible, it is generally from about 300° to about 400° C. from the viewpoints of durability and service life of the elements.

EXAMPLE

The present invention will be described in more detail with reference to the Example and Drawings. It should be understood, however that the Example and Drawings do not limit the scope of the present invention.

FIG. 1 is an explanatory illustration showing an example of the process for perforating a heat-sensitive stencil sheet according to the present invention. In FIG. 1, the perforated portion of the stencil sheet is enlarged for easy understanding of the perforation process of the invention.

In FIG. 1, numeral 1 denotes a thermal head, and numeral 2 denotes one of heat-generating elements each having a rectangular shape disposed on the thermal head. The length in the main scanning direction and that in the sub scanning direction of each of the elements are 30 μm and 40 μm, respectively. A plurality of heat-generating element 2 are arranged in line (400 dpi). According to the information of the image contained in the manuscript, electric energy is selectively supplied to each heat-generating element 2. On both sides of the linearly-arranged heat-generating elements 2, a pair of spacers **3*a* and 3*b* in the form of separate, parallel belts are formed integral with the anti-abrasion layer on the surface of the thermal head 1. The height of the outer long side in the cross-section of spacers 3*a* and 3*b* is about 1 μm, and the height of the inner short side in the same section is adjusted so that the top surfaces of the spacers 3*a* and 3*b* are in slidable contact with the surface of a platen roller 5 which will be described later. The interval between spacers 3*a* and 3*b*** is about 60 μm.

Over the plurality of linearly disposed heat-generating elements 2, a platen roller 5 made of a rubber-type elastic material (diameter: 20 mm) was disposed to face the heat-generating elements. The roller is continuously or intermittently rotated in the direction of the arrow A in FIG. 1 by an unillustrated driving means so as to synchronize with the generation of heat from the heat-generating elements 2. In this example, the platen roller 5 is pressed to the upper surfaces of spacers **3*a* and 3*b* with a pressure of 0.16 kgf/cm during perforation of the stencil sheet. However, the platen roller 5, being supported by the spacers 3*a* and 3*b*, is controlled so that its surface does not contact with heat-generating elements 2, forming a small gap 6 between the surface of the platen roller 5 and heat-generating elements 2**.

A heat-sensitive stencil sheet 4 made of a thermoplastic resin film having a thickness of 2 μm is inserted between the spacers **3*a*, 3*b* and platen roller 5, and is transferred in the direction indicated by the arrow B in FIG. 1 by an unillustrated take-up roller and the platen roller 5 while being pressed against the spacers 3*a* and 3*b*. During the transfer, pressure is applied to a thermoplastic resin film 7 that passes immediately above the heat-generating elements 2, by the contact between the platen roller 5 and spacers 3*a*, 3*b* under a pressure. The minimum gap of the resinous film 7 and the heat-generating elements 2** was 0.954 μm.

Figure 2:
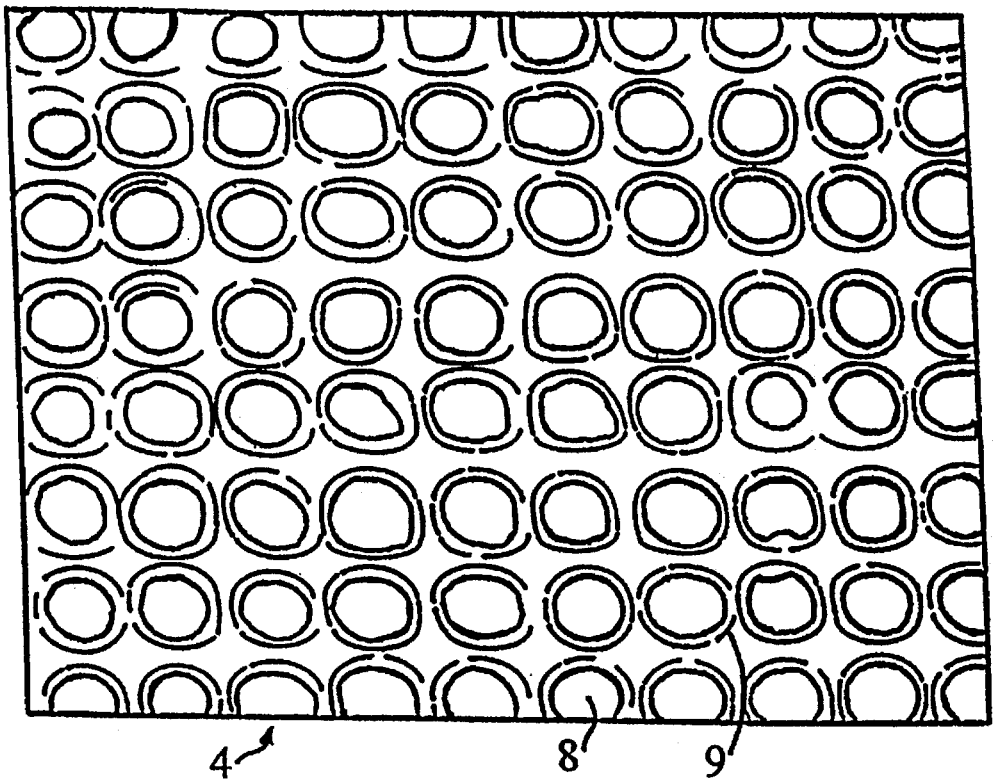
FIG. 2 is an enlarged view of perforations in a heat-sensitive stencil sheet perforated according to the method of the present invention.

Heat from heat-generating elements 2 is conducted, via a very small gap 6 formed with spacers 3*a* and 3*b*, to the thermoplastic resin film 7 to which pressure is applied. The thermoplastic resin film 7 is partially melted between the spacers 3*a* and 3*b* with the heat transferred from the heat-generating elements and shrunk back to form a perforation 8 in FIG. 1. The molted resin can be freely contracted in every direction in the plane of the film because the thermoplastic resin film 7 is not contacted with the heat-generating elements 2 and because the contracting movement in the plane of the film is not restricted. As a result, the perforation 8 which has no residual melt can be obtained. FIG. 2 is an enlarged view of perforations in a heat-sensitive stencil sheet formed according to the process of the present invention. The film portions 9 in the periphery of perforations form ridges as a result of the shrinkage of the molted resin. There is no residual melt left inside the perorations 8.

Each of the perforations 8 is formed as a hole slightly larger than the size of each of the heat-generating elements 2. This is because the small gap 6 between the heat-generating elements 2 and thermoplastic resin film 7 permits diffusion of the heat from heat-generating elements 2 beyond the projected area of each heat-generating elements 2.

If the platen roller 5 and spacers 3*a* and 3*b* are not sufficiently hard, or the contact pressure between the platen roller 5 and spacers 3*a*, 3*b* is too high, the platen roller or spacers are deformed to allow the thermoplastic resin film 7 to contact with the heat-generating elements 2. In this case, perforations of proper shape and size cannot be formed.

In FIG. 1, since the heat-sensitive stencil sheet 4 is made solely of a thermoplastic resin film, it may happen that the heat from heat-generating elements 2 diffuses to affect the circumferential film portions 9 in the periphery of perforations, causing a slight shrinkage in the film portions 9. In this case, wrinkles may be generated and printed images may be deteriorated. In order to overcome this problem, the surface of the platen roller may be subjected to such a degree of an adhering treatment that the melt-shrinkage of the thermoplastic resin film 7 in the plane of the film surface is not affected during perforation and the resin film heat treated can readily be separated away from the roller, but the shrinkage of the film in the periphery of perforations is prevented.

When a stencil sheet 4 is made of a thermoplastic resin film and a porous support which are adhered to each other with an adhesive, the stencil sheet is inserted and transferred so that the surface of thermoplastic resin film faces the heat-generating elements 2. Since the thermoplastic resin film is affixed to the porous support, the shrinking back of the film at the periphery of perforations due to the heat from heat-generating elements 2 is restricted by the porous support to prevent generation of wrinkles.

Furthermore, more excellent perforations 8 can be formed if the heat conductivity from the heat-generating elements 2 is increased by filling the gap 6 with a liquid such as a silicone oil having a heat conductivity higher than air.

Moreover, in order for the stencil sheet 4 to be smoothly moved on spacers 3*a* and 3*b*, the thermoplastic resin film or the upper surfaces of spacers 3*a* and 3*b* which contact with the film may be coated with a lubricating substance such as a silicone resin or Teflon resin.

Figure 3:
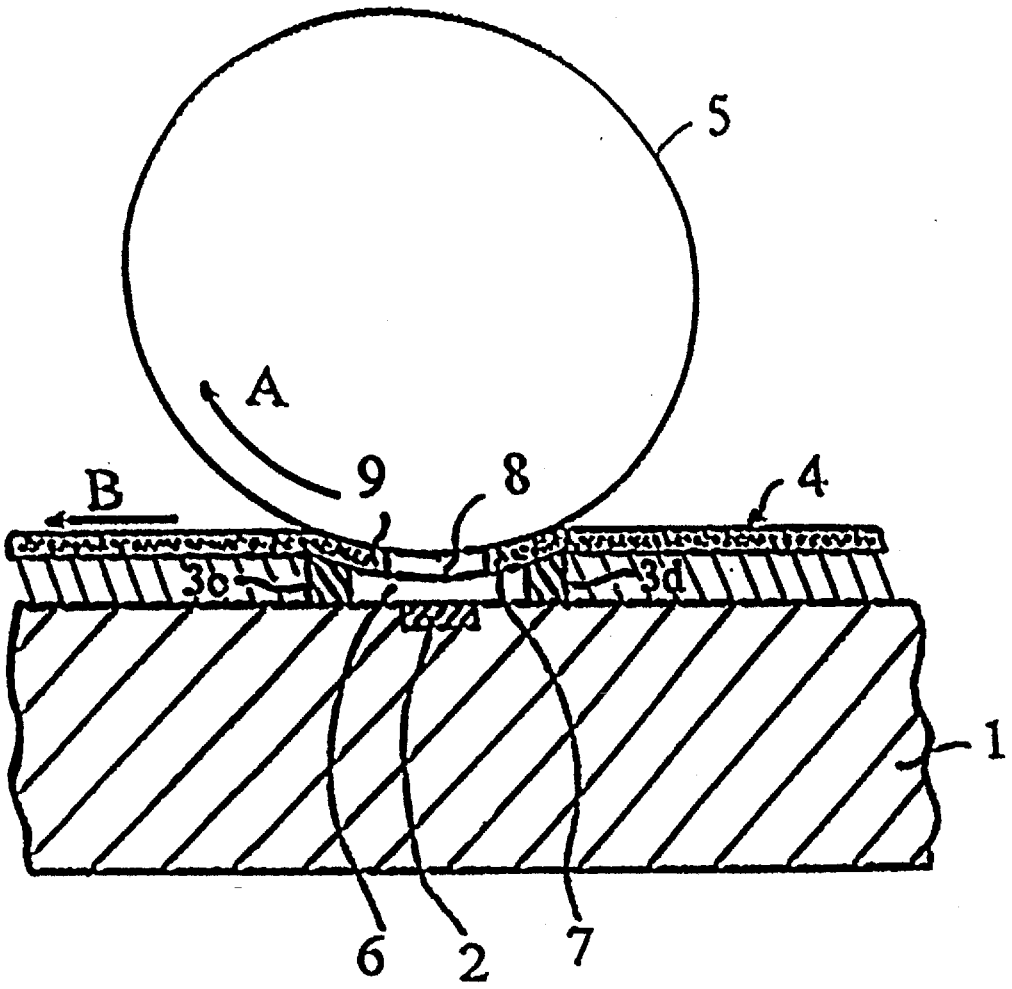
FIG. 3 is an illustration showing another example of the process for perforating a heat-sensitive stencil sheet according to the present invention.

In the present invention, as shown in FIG. 3, the spacers may be formed into a rectangular member 3*c* and 3*d* having a concavely curved surface rather than a separate, parallel belts shape, and in the bottom of its concaved surface, a plurality of heat-generating elements may be arranged in line.

The spacers 3*a* and 3*b* do not necessarily have the same height. For instance, the height of the spacer 3*a* which is on the downstream side with respect to the transferring direction of the stencil sheet 4 may be formed to be shorter than that of the spacer 3*b*. Alternatively, only a spacer 3*b* may be provided.

In FIG. 1, spacers 3*a* and 3*b* are also used to apply tension to the resinous film. However, as long as pressure is applied to the thermoplastic resin film while keeping the heat-generating elements off the resinous film, spacers 3*a* and 3*b* are not necessarily required.

According to the process of the present invention, a stencil sheet can be perforated with the heat from heat-generating elements of a thermal head, with substantially no melted resin being left in the perforations and without permitting deposition of melted resin onto heat-generating elements, perforated images which allow smooth passage of ink are formed, and as a result, clear printing images can be obtained.

What is claimed is:

1. A process for perforating a stencil printing sheet comprising a thermoplastic resin film, which process comprises:

melting the thermoplastic resin film with heat from heat-generating elements to form perforations while applying a pressure to the film and under such a condition that the film is spaced away from the heat-generating elements by a distance of 1 μm or less.

2. The process according to claim 1, wherein a pressure from 0.1 to 0.25 kgf/cm is the pressure applied on the thermoplastic resin film.

3. The process according to claim 2, wherein the pressure is applied with a platen roller.

4. A process for perforating a stencil printing sheet comprised of a thermoplastic resin film, the processing comprising:

melting the thermoplastic resin film with heat from heat-generating elements;

applying a pressure to the film while melting the thermoplastic resin film to form perforations in the thermoplastic resin film which have no resin film residue; and, providing spacing elements to maintain said stencil printing sheet spaced a fixed predetermined distance from said heat generating elements.

5. The process according to claim 4, wherein the distance between the thermoplastic resin film and the heat generating elements is 1 μm or less.

6. The process according to claim 4, wherein a pressure from 0.1 to 0.25 kgf/cm is the pressure applied on the thermoplastic resin film.

7. The process according to claim 4, wherein the pressure is applied with a platen roller.

8. The process according to claim 4, wherein the thermoplastic resin film being melted shrinks back towards a periphery of the perforations.

* * * * *